US007727609B1

(12) United States Patent
Crasno

(10) Patent No.: US 7,727,609 B1
(45) Date of Patent: Jun. 1, 2010

(54) SECTIONAL INTERLOCKING T-FOAM IMPACT BARRIER WALL

(76) Inventor: Dean Crasno, 3881 Sedgwick Ave., Bronx, New York, NY (US) 10463

( * ) Notice: Subject to any disclaimer, the term of this patent is extended or adjusted under 35 U.S.C. 154(b) by 306 days.

(21) Appl. No.: 11/681,263

(22) Filed: Mar. 2, 2007

(51) Int. Cl.
*B32B 3/06* (2006.01)

(52) U.S. Cl. ..... 428/60; 428/100; 482/23; 52/309.4; 52/582.1; 52/592.1

(58) Field of Classification Search ..... 428/60, 428/99, 100; 482/23; 52/580, 588.11, 309.4, 52/309.6, 309.9, 582.1, 586.1, 592.1, 592.4
See application file for complete search history.

(56) References Cited

U.S. PATENT DOCUMENTS

| | | | | |
|---|---|---|---|---|
| 3,564,801 | A | 2/1971 | Huerta | |
| 3,893,275 | A | 7/1975 | Omholt | |
| 4,238,914 | A | 12/1980 | Omholt | |
| 4,256,841 | A * | 3/1981 | Horacek et al. | 521/51 |
| 4,843,788 | A | 7/1989 | Gavin et al. | |
| 5,049,591 | A | 9/1991 | Hayashi et al. | |
| 5,160,785 | A | 11/1992 | Davidson, Jr. | |
| 5,606,841 | A | 3/1997 | Carter, Jr. | |
| 5,749,193 | A | 5/1998 | Bucher | |
| 6,720,402 | B2 | 4/2004 | Langer et al. | |

FOREIGN PATENT DOCUMENTS

| | | | |
|---|---|---|---|
| CA | 1158817 A | * | 12/1983 |
| DE | 2005016449 U1 | * | 3/2006 |
| EP | 0.619.989 | | 10/1994 |
| FR | 2373306 | * | 8/1978 |
| GB | 2.156.735 | | 10/1985 |
| GB | 2.349.652 | | 11/2000 |

OTHER PUBLICATIONS http://scholar.lib.vt.edu/VA-news/VA-Pilot/issues/1996/vp960512/05120017 Article—Tomberline Makes Fence Tremble (Source—the Virginian Pilot; dated May 12, 1996; Sports Section, p. C10; Staff Writer-Rich Radford.

http://www.washingtonpost.com/wp-srv/sports/redskins/longterm/1997/gamerep/week13/qb24.htm. Article-Head-Butt Turns into Real Pain in the Neck—Monday Nov. 24, 1997; p. D1—Staff writers Leonard Shapiro and Josh Barr.

(Continued)

*Primary Examiner*—Alexander Thomas
(74) *Attorney, Agent, or Firm*—Michael I. Kroll

(57) ABSTRACT

A sports arena-wall impact barrier for athletes comprising TEMPER-FOAM™ (T-foam) which has an impact absorbency factor greater than foam rubber and therefore will result in less injury to players. The players are absorbed into the pad, never contacting the solid wall eliminating injury to hand, wrist, arm shoulder, hip, knees etc. The impact barrier is comprised of overlapping panels of Temper-Foam™ (T-foam) to prevent seam separation under pressure. Preferably, Velcro® serves as the panel bonding element with the sides having a three surface contour comprising two offset substantially perpendicular surfaces with the third substantially parallel extending between the other surfaces interior ends forming a somewhat Z-shape in cross section. Since each perpendicular surface extends only partially between the front and back and that they are offset provides that an impact on the bound seam can not breech to the underlying structure.

5 Claims, 10 Drawing Sheets

OTHER PUBLICATIONS http://signonsandiego.com/sports/padres/20060618-999-1s18padres.html Article-Padres lose game and Roberts; Jun. 18, 2006; Staff writer Tom Krasovic.

http://quote.bloomberg.com/apps/news?pid=10000039reporting&sid=afFhbf780CA Article—Pad a Wall, Spare a Ball Player a Bloody Nose; Scott Soshnick, May 2006.

* cited by examiner

SECTIONAL INTERLOCKING T-FOAM IMPACT BARRIER WALL

BACKGROUND OF THE INVENTION

1. Field of the Invention

The present invention relates generally to impact barriers and, more specifically, to a sports arena-wall impact barrier for athletes comprising TEMPER-FOAM™ (hereinafter T-foam or temper foam), an open-cell polymeric memory foam material with unusual viscoelastic properties, which has an impact absorbency factor greater than foam rubber and therefore will result in less injury to players. The players are absorbed into the pad, never contacting the solid wall eliminating injury to hand, wrist, arm shoulder, hip, knees etc.

The impact barrier comprises overlapping panels of TEMPER-FOAM™ (T-foam) that are releasably secured one to the next having no seam perpendicularly extend between the front and back panel surfaces.

Each panel comprises spaced apart front and back surfaces with a top and bottom surface and contoured side surfaces forming the boundaries of the T-foam. Panel overlaps are provided on opposing sides with a releasable bonding element to prevent seam separation under pressure. Preferably, Velcro® serves as the panel bonding element with the mating Velcro® members fixed to opposing sides so that mating panels have mating Velcro® members from one to the other.

Both sides have a three surface contour comprising two offset substantially perpendicular surfaces with the third substantially parallel extending between the other surfaces interior ends forming a somewhat Z-shape in cross section. Since each perpendicular surface extends only partially between the front and back and that they are offset provides that an impact on the bound seam can not form a breech to the underlying structure as can occur on panels having a rectangular cross-section that are simply butted one to the next.

While the instant invention is disclosed in the preferred embodiment as an impact barrier for walls, the same application is applied to irregular surfaces that may include a cantilevered flange forming an end cap. Again having the result that no single-surface seam extends between the front and back surfaces.

2. Description of the Prior Art

There are other barrier device designed for impact. Typical of these is U.S. Pat. No. 3,564,801 issued to Huerta on Feb. 23, 1971.

Another patent was issued to Omholt on Jul. 8, 1975 as U.S. Pat. No. 3,893,275. Yet another U.S. Pat. No. 4,238,914 was issued to Omholt on Dec. 16, 1980 and still yet another was issued on Jul. 4, 1989 to Gavin, et al. as U.S. Pat. No. 4,843,788.

Another patent was issued to Hayashi, et al. on Sep. 17, 1981 as U.S. Pat. No. 5,049,591. Yet another U.S. Pat. No. 5,160,785 was issued to Davidson, Jr. on Nov. 3, 1992. Another was issued to Carter, Jr. on Mar. 4, 1997 as U.S. Pat. No. 5,606,841 and still yet another was issued on May 12, 1998 to Bucher as U.S. Pat. No. 5,749,193.

Another patent was issued to Langer, et al. on Apr. 13, 2004 as U.S. Pat. No. 6,720,402. Yet another U.K. Patent No. GB 2156735 was issued to Sharp on Oct. 16, 1985. Another was issued to Dodd on Apr. 13, 1994 as European Patent Application No. EP0619989 and still yet another was issued on Nov. 8, 2000 to Dodd, et al. as U.K. Patent No. GB 2349652.

A joint element for securing partitions or the like to each other, said joint element comprising parallel outer and inner leg members of substantially the same length, but offset with respect to each other, each of said outer and inner members having a free end portion and an opposite end portion, an intermediate leg member parallel to said outer and inner leg members and positioned between the same, said intermediate leg member being shorter than said outer and inner leg members and having one end portion aligned with said opposite end portion of said outer leg member and its other end portion aligned with said opposite end portion of said inner leg member, and a pair of connecting members of substantially the same length extending perpendicularly to all of said leg members, one of said connecting members connecting said one end portion of said intermediate leg member with said aligned opposite end portion of said outer leg member, and the other of said connecting members connecting said other end portion of said intermediate leg member with said aligned opposite end portion of said inner leg member, whereby said intermediate leg member is connected to said outer leg member to form a male mating means and said intermediate member is connected to said inner leg member to form a female mating means, male and female mating means of a joint element carried by one partition or the like cooperating engaging female and male mating means, respectively, of a joint element carried by another partition or the like to secure the partitions to each other, said respective joint elements when so engaged defining therebetween a tortuous path forming a hermetic seal, said joint element further including a pair of slightly spaced flange members extending perpendicularly from said free end portions of each of said outer and inner leg members for reception between each pair of flange members of facing elements forming part of a partition or the like, said flange members connected to said free end portion of said outer leg member extending toward said intermediate leg member and said flange members connected to said free end portion of said inner leg member extending away from said intermediate leg member.

A low profile rebound wall for use in sports activity is provided. The wall presents a substantially planar plumbed outer surface having almost totally uniform ball impact response characteristics and being free of vibration when struck. The wall includes spacer shims secured to a receiving surface. The spacer shims may have varying thicknesses to accommodate variations in the planarity and verticality of the receiving surface. The wall panels are in contact with the spacer shims, and a pourable material which will become adhesive and cohesive is poured between the panels and the receiving surface.

A resiliently impact cushioned adhesive-applied restricted growth low profile wall surfacing system for use in sports activities is provided. The wooden or composition wall members are held in place by spaced ridged elastomeric cushioning adhesive material between the wall members and the receiving surface. The elastomeric cushioning adhesive material has sufficient gripping and tensile strength to overcome normal horizontal and buckling expansive forces which can be generated by an increased moisture content within the wall members during periods of atmospheric moisture changes. The elastomeric cushioning adhesive material also provides substantial resilient cushioned support behind the wall members to assure desired ball rebound action, and to absorb ball impact sounds within the confines of the playing court, and provides a substantially planar wall even though the receiving surface may be relatively non-planar.

A modular seclusion room for confining violent patients wherein the four walls and floor are lined with a padded lining that is abrasion resistant, fire retardant, and shock absorbent. Ventilation and lighting are provided through the ceiling of the room and with access provided by an externally controlled closeable door through one wall. The seclusion room is portable and modular so that it may be quickly assembled within an existing structure in a number of possible sizes and configurations.

A shape memory polymer foam which takes on a deformed shape and an as-molded shaped, said deformed shape being produced when the polymer foam is compressed at a temperature higher than the glass transition point (Tg) of the polymer and then kept compressed at a temperature lower than the Tg until compression sets, said as-molded shape being produced when the compressed polymer foam is heated again to a temperature higher than the Tg until it recovers its original shape.

A resilient padding body which comprises an intermediate base layer and upper protuberances extending upwardly off the surface of the base layer and bottom protuberances extending downwardly off a lower surface of the base layer. The padding body includes longitudinal and lateral upper recesses which are formed between the upper protuberances. The upper protuberances have side walls which slope inwardly to form an object which is in the shape of a truncated pyramid and angled recesses. The base of the upper protuberances is essentially coplanar with the base member's upper surface. The base of each upper protuberance is separated by a slit which extends into the base member for about one half of the base member's thickness. The bottom protuberances include foundation sections which have vertical side walls. The foundation sections are spaced sufficiently to form a narrow channel between adjacent foundation section walls. A truncated pyramid shaped lower section extends downwardly off each of the foundation sections to form longitudinal and lateral angled recesses which open into the channels.

Interior wall panels having a rigid frame backing member to which an outer pliable sheet material is secured. A filling or padding material is retained between the sheet material and the backing member and the sheet material is secured through the filling in a plurality of spaced locations to thereby create a three dimensional surface relief. In some embodiments, the wall panels may be specifically constructed to provide thermal and sound insulating properties.

The impact wall element (1) for gentle deceleration of a human body impacting an obstacle has a two-zone structure. The first zone comprises a lightweight, plastically deformable sandwich cover plate (10) with two thin cover layers (11, 12) and an intermediately positioned, lightweight, deformable support core (13). In the second zone are provided discreet, spaced, plastically deformable spacing elements (21), which carry the cover plate and are supported on a fixed substrate (5). The thickness D2 of the second zone is more than twice the thickness D1 of the first zone. The lightweight wall element leads to a gentle interception on the shortest possible path, particularly in the case of a head impact in motor vehicles or aircraft.

Shape memory polymer compositions, articles of manufacture thereof, and methods of preparation and use thereof are described. The shape memory polymer compositions can hold more than one shape in memory. Suitable compositions include at least one hard segment and at least one soft segment. At least one of the hard or soft segments can contain a crosslinkable group, and the segments can be linked by formation of an interpenetrating network or a semi-interpenetrating network, or by physical interactions of the blocks. Objects can be formed into a given shape at a temperature above the T.sub.trans of the hard segment, and cooled to a temperature below to T.sub.trans of the soft segment. If the object is subsequently formed into a second shape, the object can return to its original shape by heating the object above the Ttrans of the soft segment and below the Ttrans of the hard segment.

A padding material, suitable e.g. for padding prison restraint cells or mental hospital rooms comprises a facing layer (1) of polyester mesh reinforced ABS bonded to an intermediate layer (5) of polyethylene foam by a heat cured adhesive. The intermediate layer (5) is bonded to a backing layer (8), e.g. by heat welding. The backing layer (8) is harder than the intermediate layer and is formed of a relatively hard layer (9) of polyethylene foam secured to a softer layer 10 of polyethylene foam. The material is secured to a surface to be padded by means of adhesive with a small gap left between adjacent sheets of padding material. The gap is filled with a sealing compound and covered by a strip of ABS which is solvent welded to the facing layer (1) of the main padding sheets.

A padded room for a veterinary hospital or the like comprises a foam layer (10) bonded to the walls and floor of the room and a polyurethane coating (15) spray-coated in situ onto the foam sheets to form a continuous skin. For formulation of the polyurethane coating provides a tough semi-rigid skin which, when bonded to the foam rubber, is able to withstand the substantial forces associated with use of the room by shod horses.

The method includes securing with adhesive, foam material to the hard surface, securing a textile material to outer surface of the foam material with an adhesive and applying to the surface of the textile material a pre-vulcanized latex liquid. Typically the hard surface to be padded is the floor or walls of a room, such as an animal enclosure or kennel and as such battens may be located at the junction between the wall and floor for additional strength. Preferably the textile material is a non-woven needle punched geo-textile, and more preferably is polypropylene. The pre-vulcanized latex liquid may be coloured and applied to the surface of the textile material by roller or as a spray.

While these barrier devices may be suitable for the purposes for which they were designed, they would not be as suitable for the purposes of the present invention, as hereinafter described.

SUMMARY OF THE PRESENT INVENTION

A primary object of the present invention is to provide a sports arena impact wall constructed of TEMPER-FOAM™.

Another object of the present invention is to provide a sports arena impact wall wherein the impact absorbency factor of TEMPER-FOAM™ is greater than foam rubber.

Yet another object of the present invention is to provide a sports arena impact wall of TEMPER-FOAM™ (T-foam) that will absorb player impact without the player ever contacting the underlying wall.

Still yet another object of the present invention is to provide a sports arena impact barrier that will prevent injury to hand, wrist, arm, shoulder, hips, knees, etc.

Another object of the present invention is to provide an impact barrier of T-foam of appropriate thickness to dissipate arena-wall impact pressure.

Yet another object of the present invention is to provide an impact barrier comprising T-foam panels having spaced apart front and back surfaces with top and bottom surfaces and contoured side surfaces.

Still yet another object of the present invention is to provide an impact barrier incorporating a releasable fastening element positioned between abutted panels.

Another object of the present invention is to provide an impact barrier T-foam panel with each side having a linearly extending overlay portion substantially forming a three surface engagement between panels.

Yet another object of the present invention is to provide an impact barrier T-foam panel with each contoured side having a panel-engagement bonding element covering.

Still yet another object of the present invention is to provide an impact barrier T-foam panel that uses Velcro® as the panel-engagement bonding element.

Another object of the present invention is to provide an impact barrier T-foam panel with each side formed of offset interiorly extending surfaces with a third surface extending between the distal ends of the other surfaces.

Yet another object of the present invention is to provide an impact barrier T-foam panel that provides that an impact on the bound seam can not form a breech to the underlying structure.

Additional objects of the present invention will appear as the description proceeds.

The present invention overcomes the shortcomings of the prior art by providing a sports arena-wall impact barrier for athletes comprising TEMPER-FOAM™ (T-foam) which has an impact absorbency factor greater than foam rubber and therefore will result in less injury to players. The players are absorbed into the pad, never contacting the solid wall eliminating injury to hand, wrist, arm shoulder, hip, knees etc.

The impact barrier is comprised of overlapping panels of TEMPER-FOAM™ (T-foam) to prevent seam separation under pressure. Preferably, Velcro® serves as the panel bonding element with each sides have a three surface contour comprising two offset substantially perpendicular surfaces with the third substantially parallel extending between the other surfaces interior ends forming a somewhat Z-shape in cross section. Since each perpendicular surface extends only partially between the front and back and that they are offset provides that an impact on the bound seam can not breech to the underlying structure.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
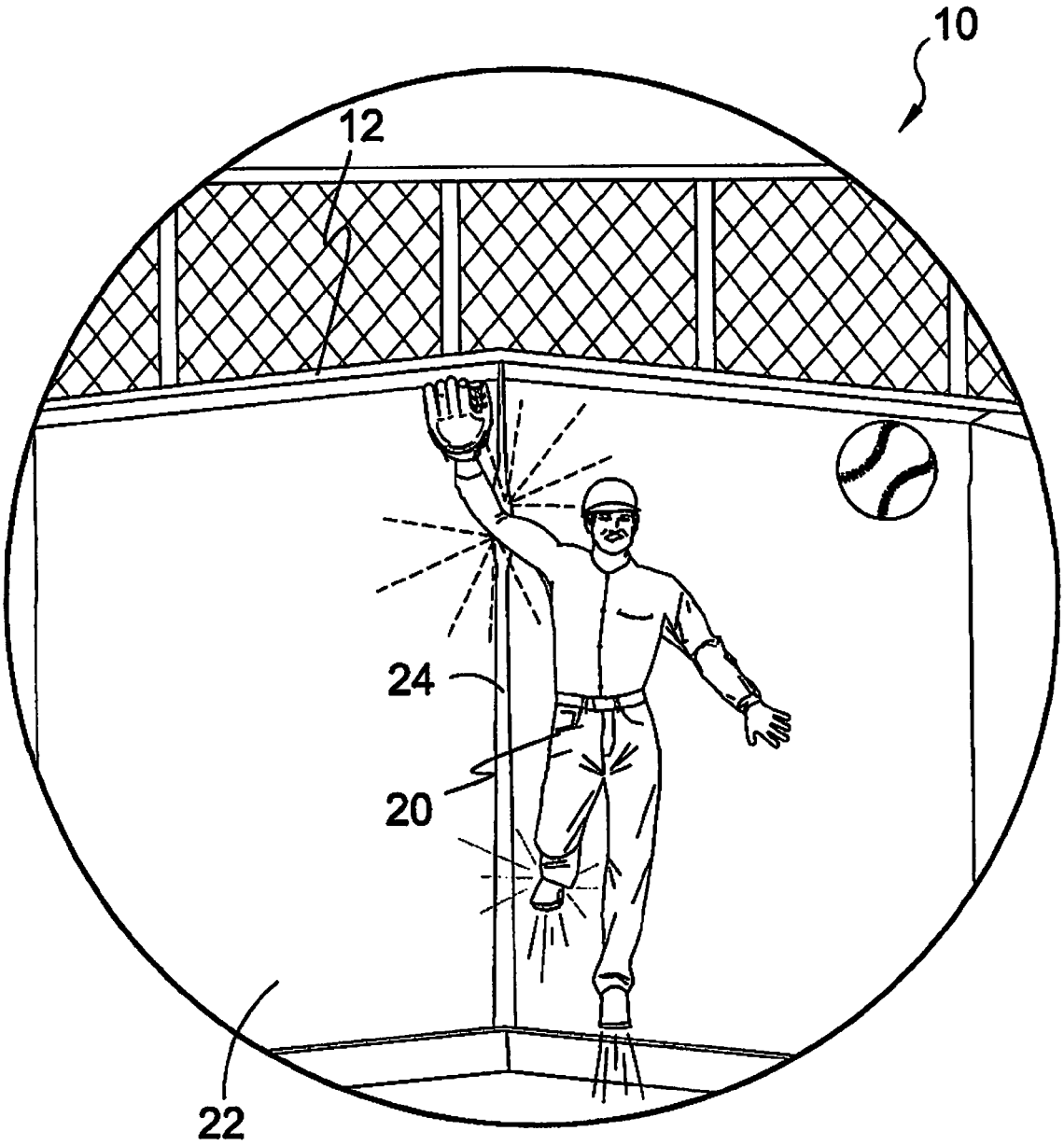
FIG. 1 (PRIOR ART)
FIG. 1 is an illustrative view of prior art.

Turning now descriptively to the drawings, in which similar reference characters denote similar elements throughout the several views, the figures illustrate the interlocking Impact Barrier Wall of the present invention. With regard to the reference numerals used, the following numbering is used throughout the various drawing figures.

10 Interlocking T-foam Impact Barrier Wall of the present invention
12 arena wall
14 T-foam wall section
16 anterior flange
18 posterior flange
20 player
22 prior art
24 seam of 22
26 seam of 10
28 hook and loop fastener element

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the impact wall of the prior art 22. Impact walls of the prior art 22 used today are designed to protect the human body upon impacting the stadium or arena wall 12 but are inadequate in providing protection for the player 20 as evident in the many career threatening injuries sustained by players 20. Seams 24 are particularly vulnerable to compression and separation upon impact.

Figure 2:
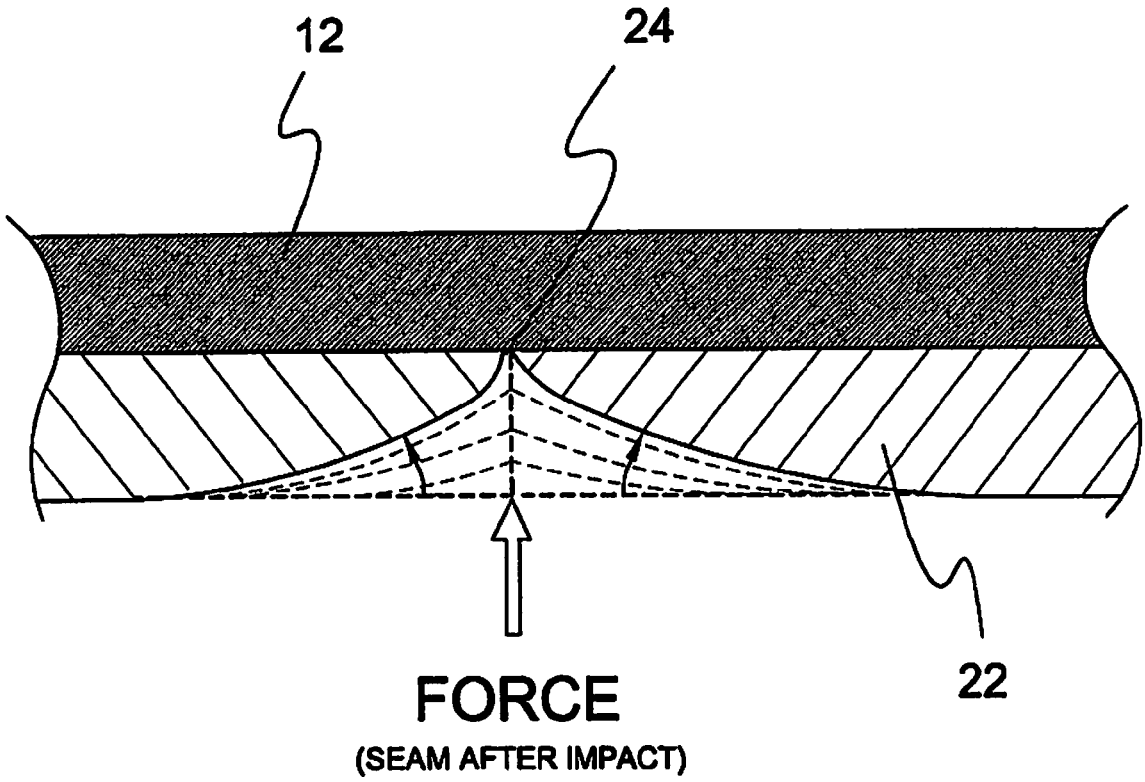
FIG. 2 (PRIOR ART)
FIG. 2 is a top sectional view of prior art upon impact.

FIG. 2 is a top sectional view of prior art 22 upon impact. Shown is an impact wall of prior art 22 for a sports arena wall 12 comprising adjoining sections for decelerating a human body impact. The panel seams 24 spread upon impact, exposing the wall 12 behind it and endangering the safety of a player upon impact.

Figure 3:
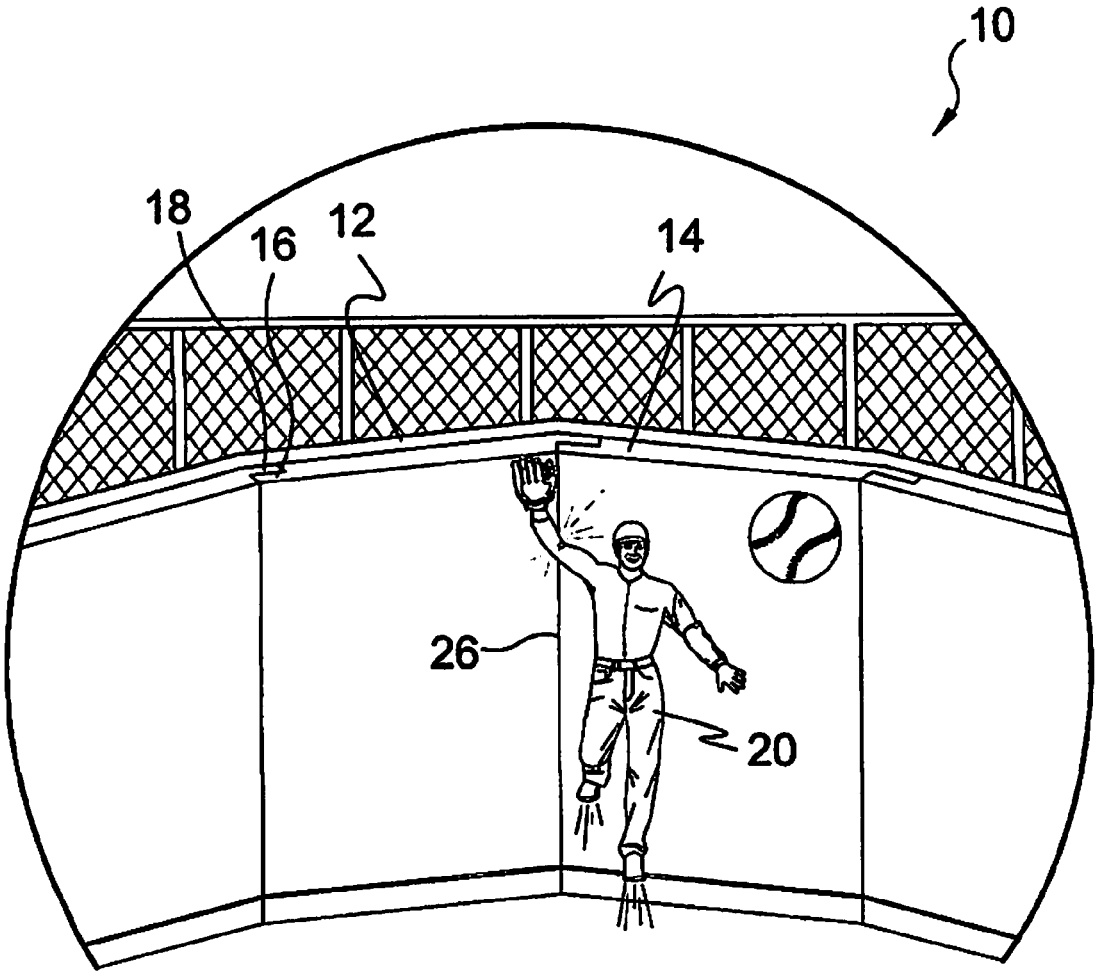
FIG. 3 is an illustrative view of the present invention in use.

FIG. 3 is an illustrative view of the present invention 10 in use. The present invention is a crash barrier wall 10 for a sports arena wall 12 comprising sections 14 forming a uniform planar surface covering a rigid wall 12 for decelerating a human body impact. The present invention 10 overcomes the shortcomings of the prior art by providing an interlocking impact barrier 10 for a sports arena wall 12 comprising wall sections 14 forming a uniform planar surface with a high impact absorbency factor for covering a rigid wall to decelerate human body 20 impact. Each wall section 12 is abutted to the adjacent wall sections 12 The temper foam panels 12 have a front surface and a rear surface with anterior 16 and posterior 18 coplanar flanges extending from opposing sides so that abutting section flanges overlap. Covering the surfaces of the abutting flanges 16,18 are mating members of hook and loop fastening elements such as Velcro® forming attachment means between the adjoining wall sections 14.

Figure 4:
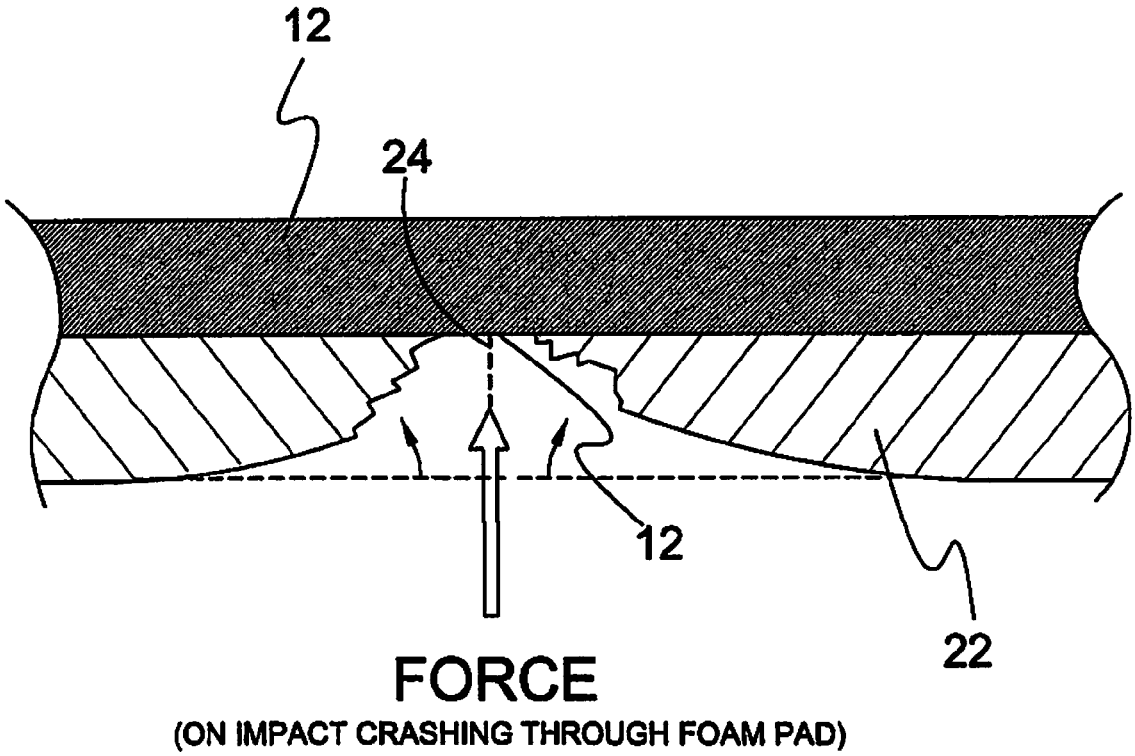
FIG. 4 (PRIOR ART)
FIG. 4 is a top sectional view of prior art upon impact.

FIG. 4 is a top sectional view of prior art 22 upon impact. Shown is an impact wall of prior art 22 for a sports arena wall 12 comprising adjoining sections for decelerating a human body impact. The panel seams 24 spread upon impact, exposing the wall 12 behind it and endangering the safety of a player upon impact.

Figure 5:
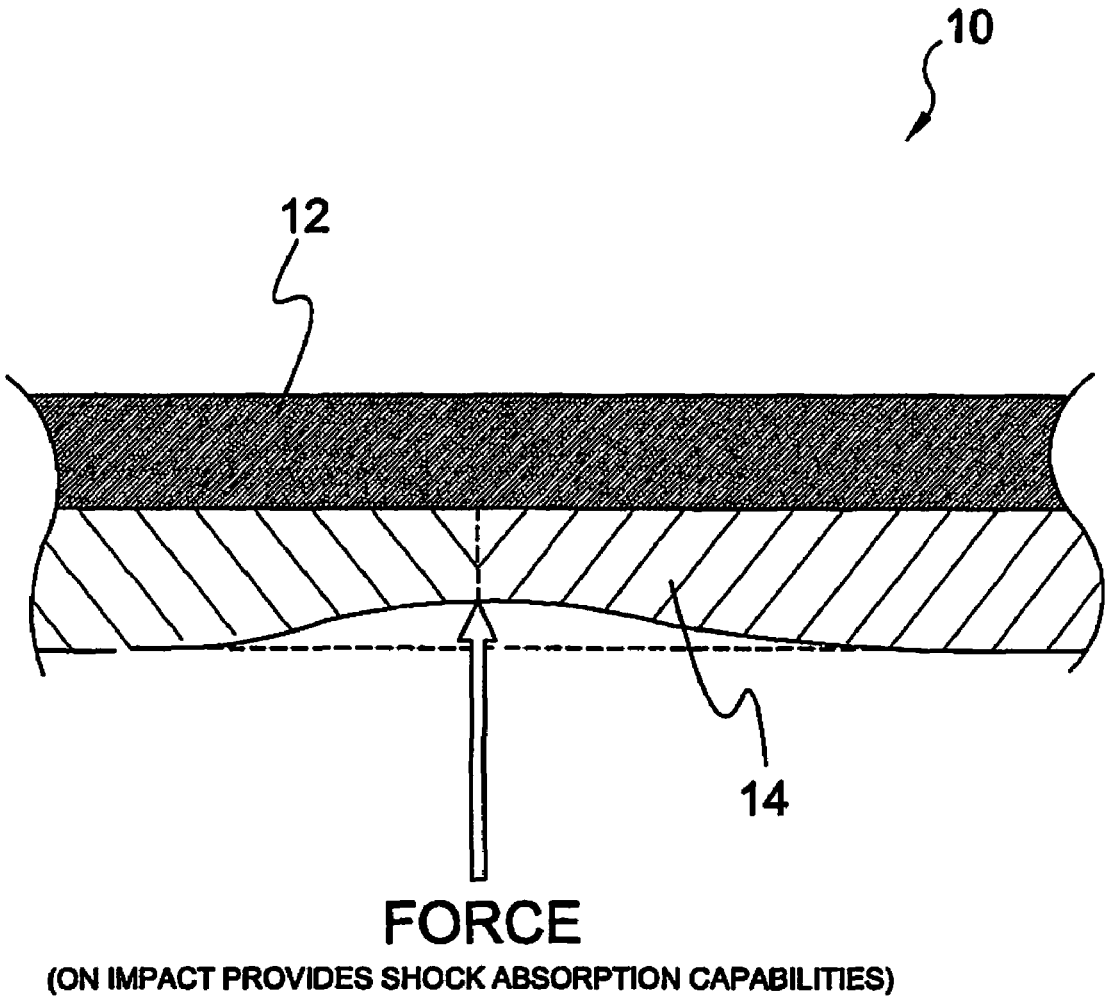
FIG. 5 is a top sectional view of the present invention upon impact.

FIG. 5 is a top sectional view of the present invention 10 upon impact. Shown is the temper foam impact wall section 14 of the present invention 10 providing greater shock absorption capabilities upon impact than the foam pads used on walls 12 in sports arenas today.

Figure 6:
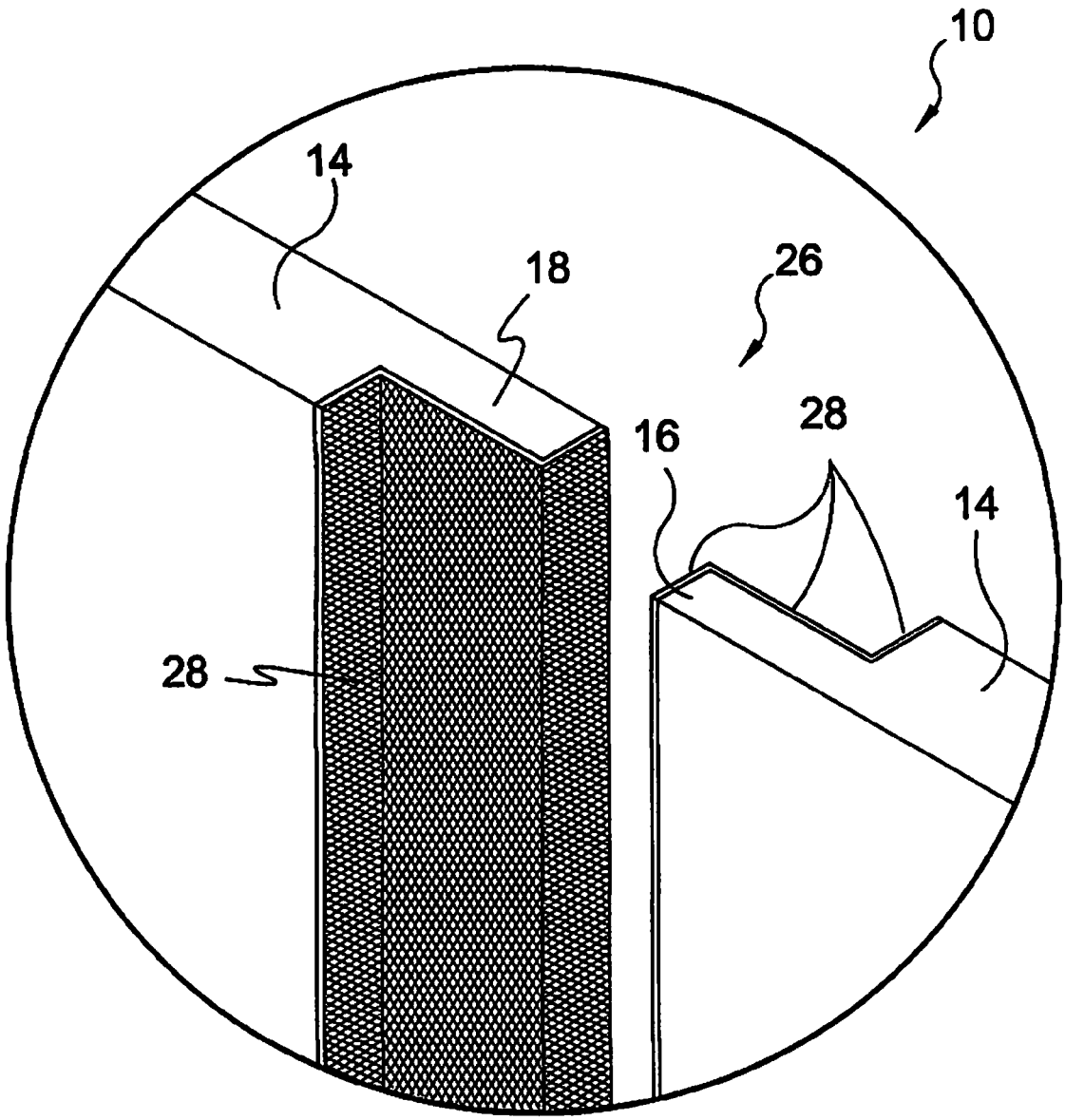
FIG. 6 is an exploded detail view of the present invention.

FIG. 6 is an exploded detail view of the seam 26 present invention 10. Shown are adjacent wall sections 14 with each panel having a coplanar anterior flange 16 and a posterior flange 18 extending from opposing sides so that abutting section flanges overlap. Covering all three surfaces of the abutting flanges are mating hook and loop fastening elements 28 between the adjoining sections 14.

Figure 7:
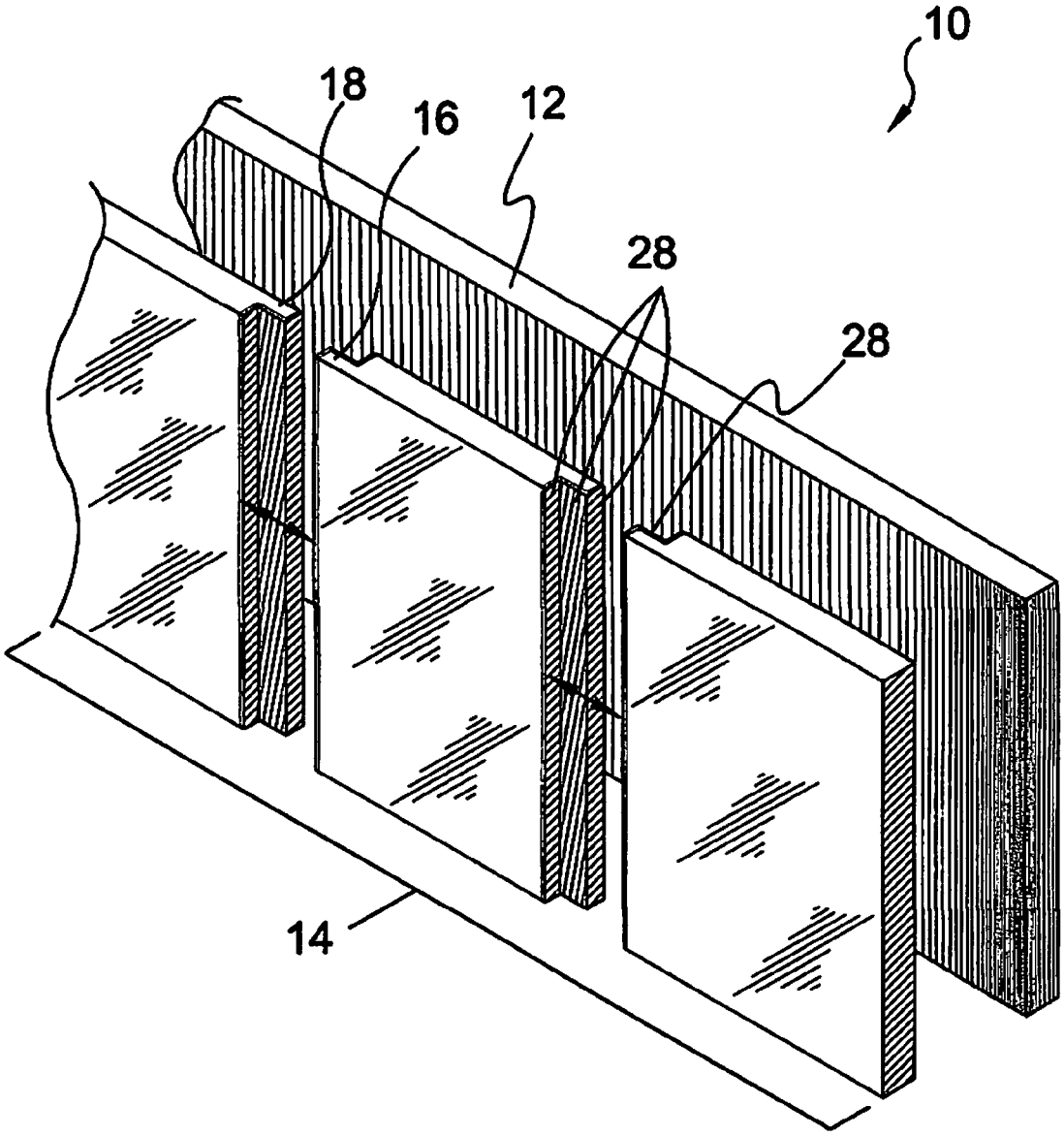
FIG. 7 is an exploded disassembled view of the present invention.

FIG. 7 is an exploded disassembled view of the present invention 10. Shown are adjacent wall sections 14 with each panel having a coplanar anterior flange 16 and a posterior flange 18 extending from opposing sides so that abutting section flanges overlap. Covering all three surfaces of the abutting flanges are mating hook and loop fastening elements 28 between the adjoining sections 14.

Figure 8:
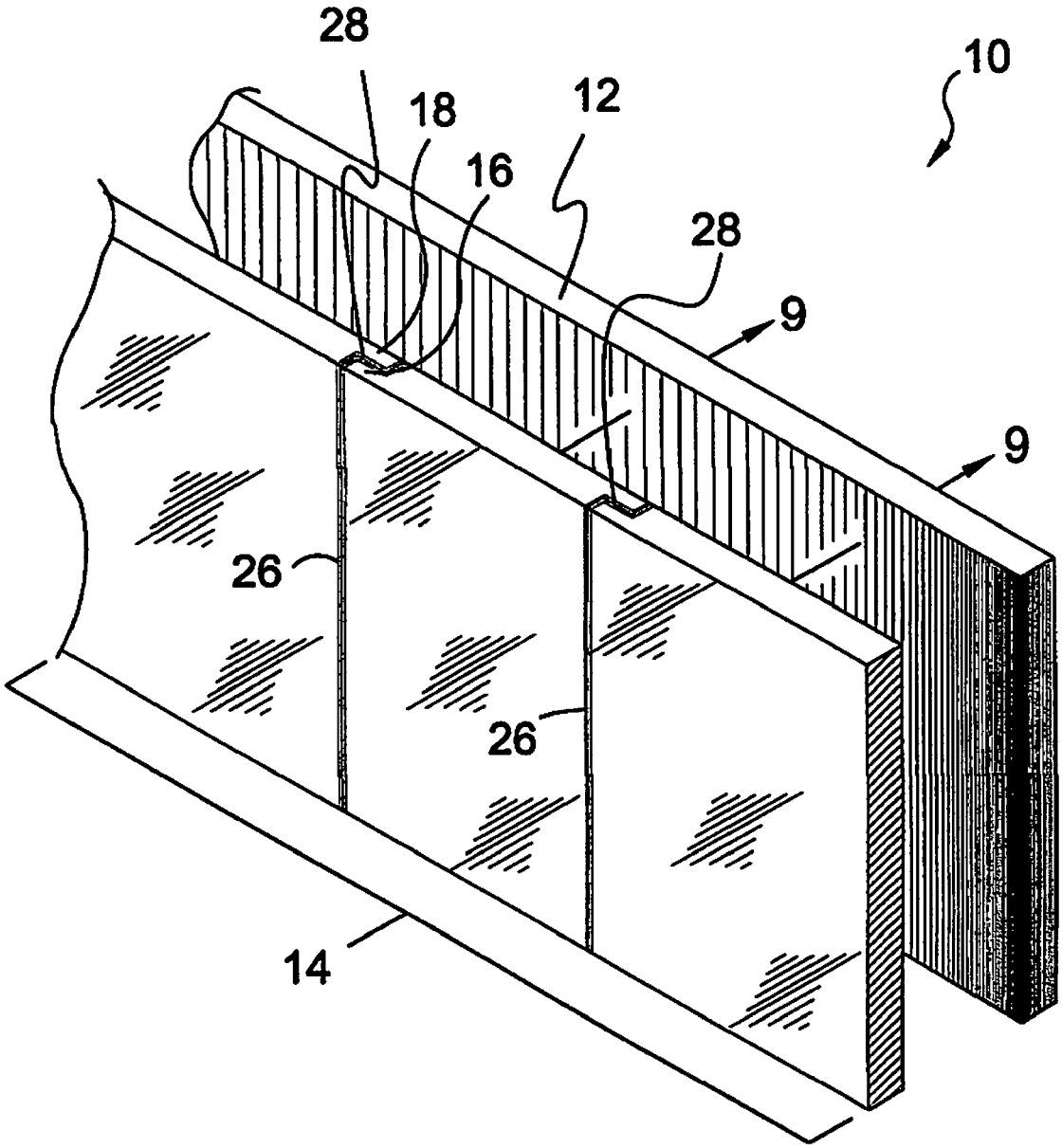
FIG. 8 is an assembled view of the present invention.

FIG. 8 is an assembled view of the present invention 10. Shown is the present invention 10, an impact wall for a sports arena wall comprising a plurality of interlocking temper-foam wall sections 14 forming a uniform planar surface covering a rigid wall 12 for decelerating a human body impact. The temper foam panels 14 having a front surface and a rear surface with coplanar anterior 16 and posterior 18 flanges extending from opposing sides so that abutting section flanges overlap. Covering the surfaces of the abutting flanges are mating hook and loop fastening elements 28 forming attachment means between the adjoining sections.

Figure 9:
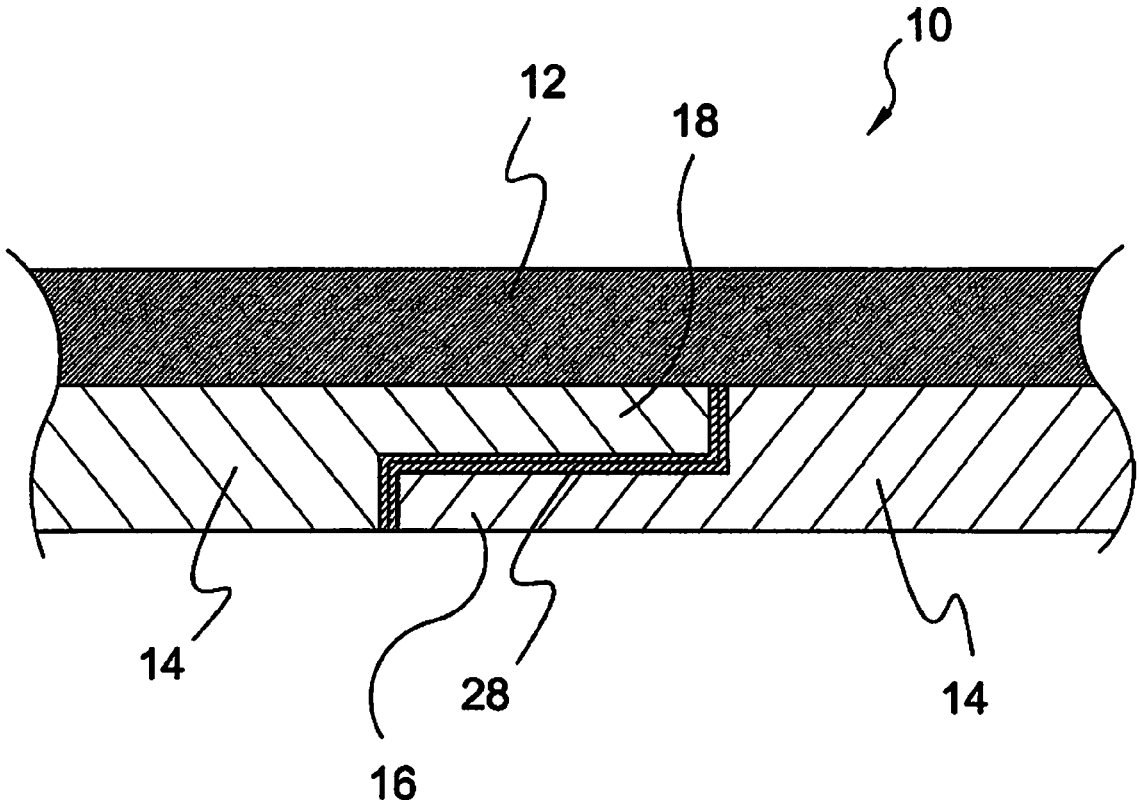
FIG. 9 is a top sectional view of adjoined temper foam panels of the present invention.

FIG. 9 is a top sectional view of adjoined temper foam panels 14 of the present invention 10. Shown is a top sectional view of the present invention 10 demonstrating how force applied to the seam 26 does not compromise the integrity thereof. The temper foam panels 14 have anterior 16 and posterior 18 coplanar flanges extending from opposing sides so that abutting section flanges overlap. Covering the surfaces of the abutting flanges are mating hook and loop fastening elements 28 forming attachment means between the adjoining sections 14.

Figure 10:
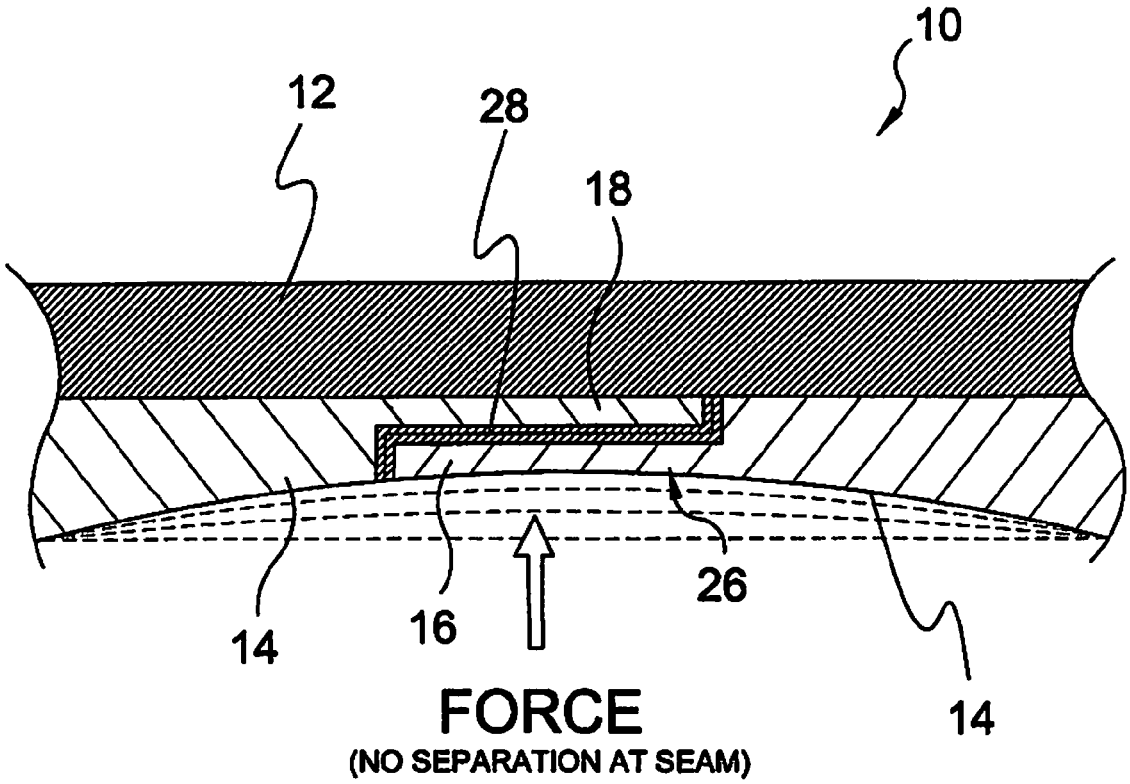
FIG. 10 is a top sectional view of the T-foam sections of the present invention upon impact.

FIG. 10 is a top sectional view of the t-foam sections 14 of the present invention 10 upon impact without exposing the arena wall 12. There is no separation of the seam 26 due to the overlapping cantilevered nature of the anterior 16 and posterior 18 flanges and the secure bonding of the two with the use of hook-and-loop fastener elements 28.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

The invention claimed is:

1. A sectional impact barrier wall having improved properties for protecting a human body when impacting the protected surface, said barrier wall comprising:

a) a plurality of adjacent wall panels fabricated of a foam padding having a high absorbency factor, each panel made up of a single layer of material;

b) each wall panel having a cantilevered portion overlapping a cantilevered portion of an adjacent wall panel for seaming said wall panels together in a manner wherein the integrity of said padding is not compromised by compression and separation when impacted thereupon, each cantilevered portion extending the full length of an edge of each wall panel;

c) wherein said wall panels have a front side and a substantially parallel rear side, the cantilevered portion extending from said front side of one panel overlaps the cantilevered portion extending from the rear side of an adjacent panel;

d) wherein facing surfaces of overlapping cantilevered portions are parallel to the front and rear sides of said wall panels, the overlapping cantilevered portions are equal in thickness to the thickness of each panel thereby forming smooth surfaces on front and rear sides of adjacent panels;

e) wherein a distal end of each cantilevered portion has a surface at right angle to the front and rear surfaces of each panel;

f) wherein an edge of each wall panel from which each cantilevered panel extends has a surface at right angle to the front and rear surfaces of each panel;

g) wherein each cantilevered portion provides three flat mating surfaces between adjacent panels; and h) wherein a releasable attachment is on each mating surface, where each releasable attachment covers substantially the entirety of each mating surface.

2. The sectional impact barrier wall recited in claim 1, wherein said panels line a front surface of a vertical, rigid wall thereby providing protection to a person impacting the rigid wall.

3. The sectional impact barrier wall recited in claim 1, wherein each cantilevered portion is substantially half of the thickness of said wall section.

4. The sectional impact barrier wall recited in claim 1, wherein each releasable attachment comprises a mating hook-and-loop fastener element.

5. The sectional impact barrier wall recited in claim 4, wherein said wall panels are pliable to enable them to conform to the curvature of the wall installed thereon.

* * * * *